US010920609B2

(12) United States Patent
Condat et al.

(10) Patent No.: US 10,920,609 B2
(45) Date of Patent: Feb. 16, 2021

(54) TURBINE ENGINE TURBINE ASSEMBLY

(71) Applicant: SAFRAN AIRCRAFT ENGINES, Paris (FR)

(72) Inventors: Hélène Myriam Condat, Limeil-Brevannes (FR); Stéphane Pierre Guillaume Blanchard, Chartrettes (FR); Sylvain Yves Jean Duval, Tournan en Brie (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 147 days.

(21) Appl. No.: 15/961,257

(22) Filed: Apr. 24, 2018

(65) Prior Publication Data

US 2018/0306057 A1 Oct. 25, 2018

(30) Foreign Application Priority Data

Apr. 25, 2017 (FR) ..... 1753552
Apr. 25, 2017 (FR) ..... 1753554

(51) Int. Cl.
*F01D 25/00* (2006.01)
*F01D 5/18* (2006.01)
(Continued)

(52) U.S. Cl.
CPC ..... *F01D 25/005* (2013.01); *F01D 5/187* (2013.01); *F01D 9/041* (2013.01); *F01D 11/08* (2013.01);
(Continued)

(58) Field of Classification Search
CPC ..... F01D 25/005; F01D 9/04; F01D 9/041; F05D 2230/642; F05D 2300/6033
See application file for complete search history.

(56) References Cited

U.S. PATENT DOCUMENTS 1,692,538 A * 11/1928 Bauman ..... F01D 25/26 415/138
2,510,735 A * 6/1950 Bodger ..... F01D 9/044 416/189
(Continued)

FOREIGN PATENT DOCUMENTS

FR 2965010 * 3/2012
GB 2261708 * 11/1992
(Continued)

OTHER PUBLICATIONS

English translation of FR2965010 (Year: 2012).*
(Continued)

*Primary Examiner* — Nathaniel E Wiehe
*Assistant Examiner* — Brian O Peters
(74) *Attorney, Agent, or Firm* — Pillsbury Winthrop Shaw Pittman LLP

(57) ABSTRACT

A turbine assembly for a turbine engine, includes a rotor disk having a plurality of CMC material blades, a stationary nozzle made of CMC material having a plurality of vanes with outer platforms forming a nozzle ring, a turbine ring made as a single piece of CMC material, and a casing of material presenting a coefficient of thermal expansion that is strictly greater than the coefficient of thermal expansion of the ceramic matrix composite material forming the blades of the rotor disk, the nozzle, and the turbine ring, the casing extending around the nozzle ring and the turbine ring, at least the nozzle ring or the turbine ring being connected to the casing via at least one sliding connection having a degree of freedom to move radially.

12 Claims, 3 Drawing Sheets

(51) Int. Cl.

| | |
|---|---|
| ***F01D 9/04*** | (2006.01) |
| ***F01D 11/24*** | (2006.01) |
| ***F01D 25/24*** | (2006.01) |
| ***F01D 25/14*** | (2006.01) |
| ***F01D 11/08*** | (2006.01) |
| *F01D 11/00* | (2006.01) |

(52) U.S. Cl.
CPC ..... *F01D 11/24* (2013.01); *F01D 25/14* (2013.01); *F01D 25/246* (2013.01); *F01D 11/005* (2013.01); *F05D 2220/323* (2013.01); *F05D 2230/642* (2013.01); *F05D 2240/11* (2013.01); *F05D 2260/221* (2013.01); *F05D 2300/6033* (2013.01)

(56) References Cited

U.S. PATENT DOCUMENTS 6,968,696 B2 * 11/2005 Little ..... F01D 5/08 60/772
8,496,431 B2 * 7/2013 Habarou ..... F01D 9/04 415/170.1
8,770,931 B2 * 7/2014 Alvanos ..... C04B 37/001 29/889.22
8,951,017 B2 * 2/2015 Cordier ..... F01D 5/282 416/220 R
2005/0050901 A1 * 3/2005 Little ..... F01D 5/08 60/785
2005/0158171 A1 * 7/2005 Carper ..... B32B 18/00 415/200
2010/0111678 A1 * 5/2010 Habarou ..... F01D 9/04 415/173.3
2012/0027605 A1 * 2/2012 Cordier ..... F01D 5/282 416/220 R
2012/0301303 A1 * 11/2012 Alvanos ..... C04B 37/001 416/179
2012/0301315 A1 11/2012 Alvanos et al.

FOREIGN PATENT DOCUMENTS

| | | | |
|---|---|---|---|
| GB | 2261708 | * | 5/1993 |
| WO | WO 95/31631 A1 | | 11/1995 |
| WO | WO 2014/120334 A1 | | 8/2014 |
| WO | WO 2016/052177 A1 | | 4/2016 |

OTHER PUBLICATIONS

Search Report as issued in French Patent Application No. 1753554, dated Jan. 9, 2018.
Search Report as issued in French Patent Application No. 1753552, dated Dec. 19, 2017.

* cited by examiner

TURBINE ENGINE TURBINE ASSEMBLY

CROSS-REFERENCE TO RELATED APPLICATIONS

This application claims priority to French Patent Application No. 1753552, filed Apr. 25, 2017 and French Patent Application No. 1753554, filed Apr. 25, 2017, the entire contents of which are incorporated herein by reference in their entireties.

FIELD

The invention relates to a turbine assembly for a turbine engine. The field of application of the invention is in particular that of gas turbine aeroengines. Nevertheless, the invention is applicable to other turbine engines, e.g. to industrial turbines.

BACKGROUND

In gas turbine aeroengines, improving efficiency and reducing polluting emissions lead to reducing the weights of parts constituting the engine and to making the engine operate at ever higher temperatures. Ceramic matrix composite (CMC) materials are known for their good mechanical properties, which make them suitable for constituting structural elements, and they are also known for conserving those properties at high temperatures, thereby leading to a viable alternative to conventional parts made of metal. The use of CMC material parts in the hot portions of such engines has already been envisaged for the above-mentioned reasons. In particular, successfully introducing rings and rows of airfoils made of CMC material into the hot portions of a turbine engine, such as the low pressure turbine, presents a major issue for reducing the weight of the turbine.

Nevertheless, the use of CMC materials presents limits. In particular, they have coefficients of thermal expansion that are much smaller than those of metal materials. In other words, at high temperatures, parts made of CMC material expand less than do parts made of metal material, thereby leading to major problems of integration, in particular when it is desired to control clearances between different parts.

At present, it is difficult to envisage a turbine being made entirely out of CMC material, and certain structural parts, such as the casing surrounding the rotor and stator rows of airfoils, or the blade disks of the rotor, still need to be fabricated out of metal material. In this context, there still exists a need for a turbine architecture that makes it possible to integrate CMC material parts in a metal environment.

SUMMARY

A main aspect of the present invention is thus to mitigate such drawbacks by proposing a turbine assembly for a turbine engine, the turbine assembly comprising:

a rotor disk having a plurality of blades made of ceramic matrix composite material;

a stationary nozzle made of ceramic matrix composite material arranged downstream from the rotor disk and comprising a plurality of vanes, each nozzle vane having an outer platform at an outer end, the outer platforms of the nozzle vanes together forming a nozzle ring around the nozzle vanes;

a turbine ring made as a single piece of ceramic matrix composite material having an inside face facing the outer ends of the blades of the rotor disk, the turbine ring being fastened to the nozzle ring in such a manner that the turbine ring and the nozzle ring together define an annular wall corresponding to the outer wall of a gas flow passage through the turbine; and a casing made of a material presenting a coefficient of thermal expansion that is strictly greater than the coefficient of thermal expansion of the ceramic matrix composite material forming the blades of the rotor disk, the nozzle, and the turbine ring, the casing extending around the nozzle ring and the turbine ring, at least the nozzle ring or the turbine ring being connected to the casing via at least one sliding connection having a degree of freedom to move radially.

Throughout the disclosure, the terms “inside”, “outside”, “inner”, “outer”, “axial”, “radial”, and their derivatives are defined relative to the axis on which the turbine is centered, which also coincides with the longitudinal axis of the turbine engine in which the turbine is to be used. The terms “upstream” and “downstream” are defined relative to the flow direction of gas through the turbine when it is in operation.

The turbine assembly of embodiments of the invention makes it possible to use a large number of elements made of CMC material in the turbine so as to reduce the weight of the assembly, while conserving a structural casing made of a material that presents a coefficient of thermal expansion that is strictly greater than the coefficient of expansion of the ceramic matrix composite material forming the rotor blades, the nozzle vanes, and the turbine ring. Such a casing may typically be made of metal material.

In a turbine, it is important to be able to control the clearance or spacing that exists between the blades of the rotor disk and the turbine ring surrounding those blades in order to maximize the sealing between those elements while the turbine is in operation, thereby improving its efficiency. Using CMC material for the blades of the rotor disk and for the turbine ring serves to provide good sealing by avoiding the problems of differential expansion that would otherwise exist between blades made of CMC material and a turbine ring made of metal, or vice versa. An aspect of the invention also proposes using a nozzle comprising stationary vanes provided with outer platforms and made entirely out of CMC material, likewise for reducing the weight of the assembly. The nozzle may be made as a single-piece or it may be made up of sectors.

Integrating the assembly formed by the rotor disk, the turbine ring, and the nozzle inside a casing as defined above is made possible by incorporating a sliding connection between the casing and the assembly formed by the turbine ring and the nozzle. In known manner, a sliding connection is a type of mechanical connection that allows movement in translation between two parts with a single degree of freedom, specifically, radially. As a result, the casing can move relative to the turbine ring and to the nozzle solely in a radial direction, without stressing the nozzle and/or the turbine ring to which it is connected. Specifically, when hot, the casing will tend to expand more than the turbine ring and the nozzle, and will move radially without stressing the turbine ring and the nozzle. In addition, expansion of the casing serves to create additional clearance when hot between the casing and the ring or the nozzle so as to further reduce such stresses. Finally, the sliding connection makes it possible to guarantee axial centering of the nozzle and of the turbine ring relative to the casing.

The ring and the nozzle can be held axially relative to the casing at least in part by spring elements connecting the turbine ring and the nozzle either to the casing or else to a high pressure turbine nozzle situated upstream from the turbine. The ring and the nozzle may be held radially using a pivot connection, e.g. using rolling bearing devices, e.g. located between the nozzle and the turbine rotor.

Beneficially, the annular wall may be cylindrical in shape. For this purpose, the turbine ring and the nozzle ring may be cylindrical in shape, i.e. they may present a circular section that is constant. This configuration makes it possible to have a single-piece turbine ring that is very simple in design. With such a provision, the blades of the rotor disk may present outer ends that are rectilinear and parallel to the axis of the turbine and to the inside face of the turbine ring when seen in longitudinal section, which ends do not include wipers or outer platforms. Thus, the radial clearance between the blades of the rotor disk and the turbine ring can be controlled more simply, and the blades are simpler to fabricate. The radial clearance is also preserved while the turbine is in operation since the blades and the ring are both made of CMC material, and thus expand in the same manner. Furthermore, there is no need to control accurately the axial clearances between the blades of the rotor disk and the turbine ring since the blades can move axially without running any risk of coming into contact with the turbine ring. Finally, a turbine assembly presenting such a characteristic is easier to assemble than is a turbine presenting a gas flow passage with an outer wall that is not cylindrical.

In an embodiment, when the annular wall is cylindrical in shape, the rotor disk may be made of metal material, and the assembly may further comprise a cooling device for cooling the rotor disk with air taken from a cold portion of the turbine engine, the device being controlled so as to adjust radial clearance between the ends of the blades carried by the rotor disk and the inside face of the turbine ring. A cold portion of the turbine engine may be a compressor of the engine.

The cooling device may be controlled, e.g. it may be activated or deactivated, in order to adjust the radial clearance between the blades of the rotor disk and the turbine ring. Specifically, the rotor disk in the turbine assembly of this example is made of metal material and therefore presents a coefficient of thermal expansion that is greater than that of the CMC material. Thus, by cooling the rotor disk to a greater or lesser extent, it is possible accurately and in simple manner to increase or to reduce the clearance that exists between the ends of the CMC blades and the inside face of the turbine ring.

A turbine assembly having such a cooling device may enable a method to be performed for adjusting radial clearance between the tips of the blades carried by the rotor disk and an inside face of a turbine ring in a turbine assembly as described above, the radial clearance being adjusted by controlling the cooling device.

In particular, the device for cooling the rotor disk may have a cold air delivery channel leading to the rotor disk and provided with a valve.

In an embodiment, a turbine assembly of the invention may constitute a low pressure turbine of an aviation turbine engine.

The nozzle and the turbine ring may form two distinct parts. Under such circumstances, the turbine ring may be fastened to the nozzle ring in leaktight manner, e.g. using a leaktight fastener device. In particular when the nozzle is sectorized, such a leaktight fastener device may comprise a groove in an edge of the turbine ring or of the nozzle ring, and a tongue on an edge of the nozzle ring or of the turbine ring and co-operating with the groove, it being possible to have a sealing gasket present between the groove and the tongue. In a variant, in particular when the nozzle is made as a single piece, such leaktight fastener device may comprise rims on the turbine ring and on the nozzle ring that co-operate with each other and that are separated by an annular sealing gasket.

In a variant, the turbine ring and the nozzle may form a single part. This provision makes assembling the turbine assembly even easier, in particular by reducing the number of parts, and by eliminating the need to use leaktight fastener means.

In an embodiment, the nozzle may be connected to the casing via at least one sliding connection presenting a degree of freedom to move radially.

Under such circumstances, the casing may include a groove in an inside face and the nozzle ring may have a tongue on an outside face that is received in the groove of the casing. The tongue and the groove may extend over the entire circumference of the inside face of the casing and the outside face of the nozzle ring, or in a variant they may extend over a portion only of their circumference.

In an embodiment, the turbine ring may be connected to the casing via at least one sliding connection presenting a degree of freedom to move radially.

Under such circumstances, the casing may have a groove in an inside face and the turbine ring may have a tongue on an outside face, which tongue is received in the groove of the casing. The tongue and the groove may extend over the entire circumference of the inside face of the casing and of the outside face of the turbine ring, or in a variant, over only a portion of their circumference.

In the above embodiments, tongue-and-groove co-operation serves to obtain a sliding connection. Specifically, this co-operation leaves the casing with a degree of freedom to move radially relative to the turbine ring and to the nozzle, while still ensuring that the nozzle and the turbine ring are axially centered relative to the casing. When hot, the groove may expand with expansion of the casing, thereby creating additional clearance relative to the tongue, thus allowing the casing to move radially outwards without stressing the turbine ring and the nozzle made of CMC material, which expand less.

An aspect of the invention also provides an aviation turbine engine including a turbine assembly as described above.

BRIEF DESCRIPTION OF THE DRAWINGS

Other characteristics and benefits of the present invention appear from the following description made with reference to the accompanying drawings, which show an embodiment having no limiting character. In the figures.

DETAILED DESCRIPTION

Figure 1:
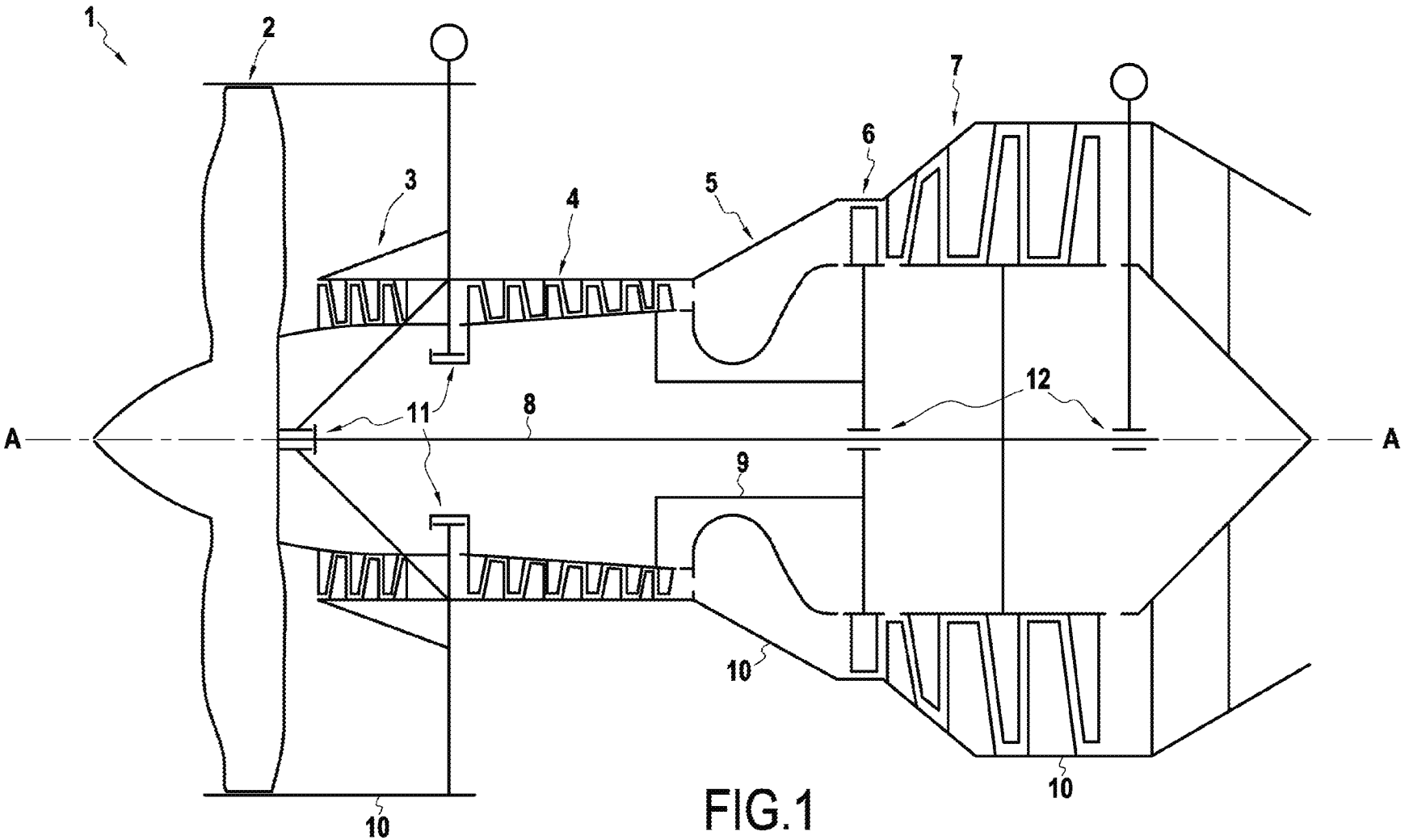
FIG.1 PRIOR ART
FIG. 1 is a diagrammatic longitudinal section view of a known aviation turbine engine.

FIG. 1 is a diagrammatic longitudinal section view of a known aviation turbine engine. In the example shown, the turbine engine consists in a bypass turbojet 1 centered on an axis A-A. From upstream to downstream, the turbojet 1 comprises: a fan 2; a low pressure compressor (or booster) 3; a high pressure compressor 4; a combustion chamber 5; a high pressure turbine 6; and a low pressure turbine 7.

The turbojet 1 has a low pressure module comprising the fan 2, the low pressure compressor 3, and the low pressure turbine 7, with the elements making up this module being constrained to rotate together with a low pressure shaft 8 that extends along the axis A-A. In similar manner, the high pressure turbine 6 is constrained to rotate together with the high pressure compressor 4 by means of a high pressure shaft 9. Both the high pressure portions and the low pressure portions of the turbojet 1 are made up respectively of a rotary portion (or rotor) and a stationary portion (or stator).

FIG. 1 shows the main mechanical connections involved in the turbojet 1 between its various component elements. The stationary portions of each element of the turbojet 1 are generally connected to one or more casings 10, while the movable portions may be connected to a rotary shaft such as the low pressure shaft 8 or the high pressure shaft 9. The stationary and movable portions are generally connected to one another by pivot type connections 11 or by sliding pivot type connections 12. In practice, the pivot connections 11 and 12 may be embodied using rolling bearing devices.

Figure 2:
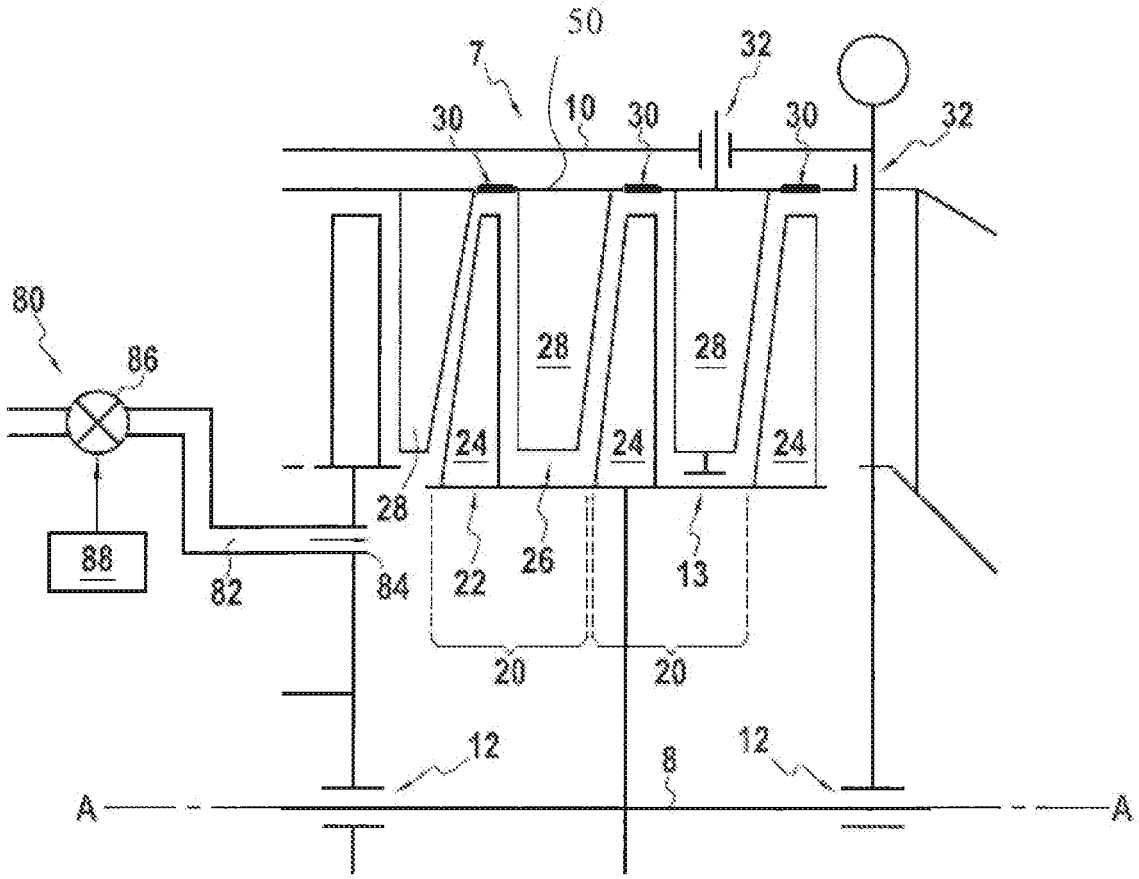
FIG. 2 is a diagrammatic view showing the low pressure turbine of the turbine engine in an embodiment of the invention.

FIG. 2 is a diagram of a turbine engine of the invention showing its low pressure turbine 7. The turbine 7 comprises a plurality of turbine stages 20, each turbine stage 20 comprising a rotor disk 22 having a set of blades 24 mounted thereon that are driven in rotation by the rotor disk 22, and a nozzle 26 situated downstream from the rotor disk 22 and comprising a set of stator vanes 28. The rotor disk 22 is connected to the low pressure shaft 8, while the nozzle 26 is connected to the casing 10. A pivot connection 13 may be present between a nozzle 26 and a rotor disk 22. The turbine stage 20 also has a turbine ring 30 of position shown in FIG. 2, situated facing the rotor blades 24 and secured to the nozzle 26.

The blades 24, the nozzle 26, and the turbine ring 30 are made of CMC material. The casing 10 is made of material presenting a coefficient of thermal expansion that is strictly greater than that of the CMC material, e.g. out of a metal material. The rotor disk 22 in this example is also made of a metal material. It should be observed that in other examples that are not shown, the rotor disk 22 may be made of some other material. The turbine ring 30 and the nozzle 26 are connected to the casing 10 via sliding connections 32 presenting a degree of freedom directed along a radial axis, i.e. along an axis perpendicular to the axis A-A of the turbojet 1 and passing therethrough. The sliding connections 32 serve to accommodate the differential expansion that exists between the casing 10 and the CMC material elements of the turbine 7, by allowing the casing to expand radially and axially without stressing the turbine ring 30 and the nozzle 26. In the example shown, the assembly comprising the nozzles 26 and the turbine rings 30 is connected to the rotor disks 22 of the turbine 7 via a sliding pivot type connection 11. In the example shown where the rotor disk 22 is made of metal material, the turbine 7 also has a device 80 for cooling the rotor disk, which device is described in greater detail below.

Figure 3:
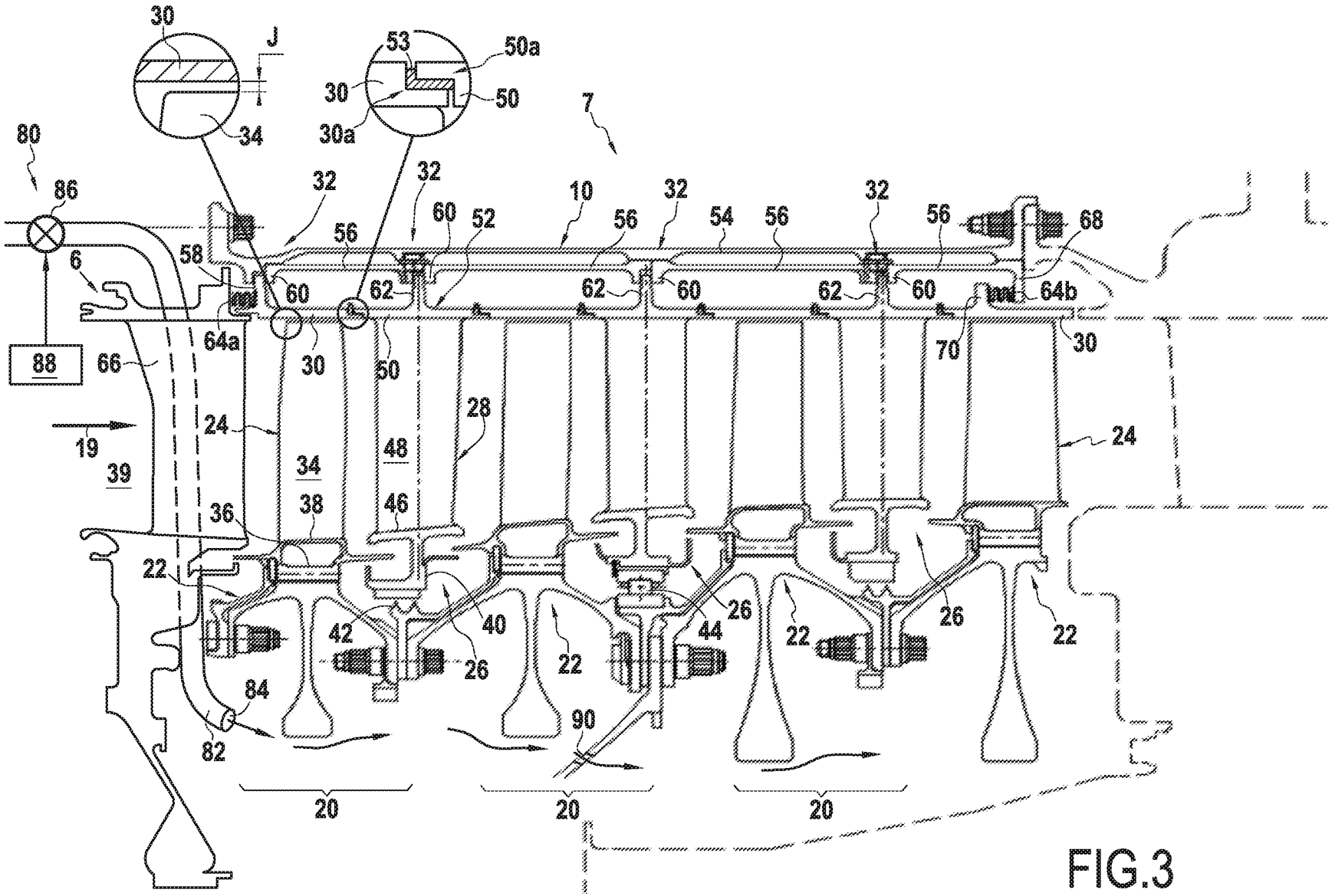
FIG. 3 is a detailed longitudinal section view of an example of a low pressure turbine for an aviation turbine engine in an embodiment of the invention, in which the nozzle is made as a single piece.

An example of a turbine 7 of the invention is described below with reference to FIG. 3, which is a detailed section view. The reference symbols used above in FIGS. 1 and 2 are applicable to FIG. 3, unless specified to the contrary. In FIG. 3, the flow direction of the gas through the turbine 7 is represented by arrow 19.

In this example, the turbine 7 has three complete turbine stages 20 together with an additional turbine disk 22 downstream from the stages 20. As explained above, each stage 20 has a rotor-forming portion with a rotor disk 22, and a stator-forming portion, in particular with a nozzle 26 situated downstream from the rotor disk 22.

Each rotor disk 22 has a set of blades 24 made of CMC material. Each blade 24 has an airfoil 34 that extends radially from a root 36 that is engaged in the rotor disk 22 and a platform 38 that is situated between the root 36 and the airfoil 34 in order to define the inside of the gas flow passage 39 through the turbine 7. The blades 24 in this example do not have outer platforms or wipers.

The CMC material nozzle 26 comprises a set of stationary vanes 28. Each vane 28 comprises a root 40 that may be provided on an inside face with an abradable coating for coming into contact with wipers 42 fastened to the rotor disk 22 in order to seal the inside of the passage 39. The root 40 of each vane 28 of the nozzle 26 may equally well be connected to a rotor disk 22 via rolling bearing devices 44. Each vane 28 also has an inner platform 46 and an airfoil 48 extending between the inner platform 46 and an outer platform 50 situated at the outer end of the vane 28.

Each turbine stage 20 also has a turbine ring 30 made as a single piece of CMC material facing the ends of the blades 24 of the rotor disk 22. In the example shown, the turbine ring 30 is in the form of a cylindrical ring centered on the axis A-A of the turbine. The turbine ring 30 is fastened to the outer platforms 50 of the vanes 28 of the nozzle 26, which outer platforms 50 also together constitute a nozzle ring 52 that is likewise cylindrical in shape. The turbine ring 30 is fastened to the nozzle 26 so as to guarantee that the passage 39 is leaktight relative to the outside. Thus, the turbine ring 30 and the nozzle ring 52 together form a cylindrical wall defining the outside of the passage 39.

In the example shown, the nozzle ring 50 is a single piece. In this example, the turbine ring 30 is fastened to the nozzle ring in leaktight manner by co-operation between a rim 30*a* present on an edge of the turbine ring 30 and a corresponding rim 50*a* present on the nozzle ring 52. In order to provide sealing, a gasket 53 is provided between the rims 30*a* and 50*a*.

Figure 4:
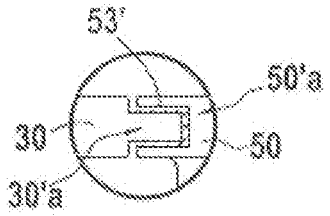
FIG. 4 is an enlarged longitudinal section view showing a device for leakproof fastening between the turbine ring and the neighboring nozzle in a low pressure turbine in another embodiment, in which the nozzle is made up of sectors.

In the variant shown in FIG. 4, the nozzle ring 50 is made up of sectors. Under such circumstances, the turbine ring 30 is fastened to the nozzle ring 52 in leaktight manner by co-operation between a groove 50'*a* present in an edge of the nozzle ring 52 and a tongue 30'*a* present on an edge of the turbine ring 30. To provide this sealing, a gasket 53' is provided in the groove 50'*a*. It should be observed that in a variant the groove could be present in an edge of the turbine ring 30 while the tongue is present on an edge of the nozzle ring 52.

In the configuration shown in FIG. 3, the blades 24 of the rotor disk 22 have respective airfoils 34, each with a top end that is rectilinear and parallel to the inside face of the turbine ring 30, when seen in longitudinal section. In other words, the outer end of each airfoil 34 situated facing the turbine ring 30 is parallel to the axis A-A of the turbine 7. As a result, the presence of outer platforms and of wipers on the outer ends of the blades 24 of the rotor disk 22 is not necessary. Specifically, it is easier to control the radial clearance between the blades 24 and the turbine ring 30 when the ring 30 is cylindrical and the ring 30 and the blades 24 are made of CMC material. In addition, controlling the axial clearance when positioning the blades 24 is less critical. This configuration makes it possible to obtain blades 24 of design that is simpler and that are easier to install.

The turbine 7 also has an annular casing 10 of cylindrical shape arranged around the turbine stages 20. The casing 10 comprises an outer casing 54 and a support structure made up of a plurality of cylindrical rings 56 that are secured to one another and fastened to the inside of the outer casing 54. In the example shown, the turbine ring 30 of the first turbine stage 20, i.e. the stage situated furthest upstream within the turbine 7, presents on its outside face and at its upstream end a tongue 58 that is received in a groove 60 formed in the inside face of the casing 10. More precisely, the groove 60 is defined between a ring 56 and the outer casing 54.

Still in the example shown, the nozzle ring 26 of the first turbine stage 20 formed by the set of outer platforms 50 comprises a tongue 62 on an outside face that is received in a groove 60 present in an inside face of the casing 10. More precisely, the groove 60 is defined between two consecutive rings 56 of the casing 10. The tongues 58 or 62 may be present over the entire periphery of the ring 30 or of the nozzle 26. The tongues 58, 62 extend radially outwards. The rings 56 of the casing 10 extend axially between two consecutive tongues 58 or 62. In the first nozzle stage 20, the turbine ring 30 and the nozzle 26 are both connected to the casing 10 by a sliding connection 32 with a degree of freedom to move radially, the sliding connection 32 resulting from co-operation between a tongue 58 or 62 and a groove 60. It should be observed that for the other stages 20 of the turbine 7, only the nozzle is connected directly to the casing 10 by a sliding connection 32, resulting from co-operation between a tongue 62 and a groove 60.

In the example shown, the assembly formed by the nozzles 26 and the turbine rings 30 is also held axially by resilient sealing gaskets 64*a*, 64*b*. An upstream gasket 64*a* is connected to the nozzle 66 of the high pressure turbine 6 and also to the tongue of the turbine ring 30 of the first turbine stage 20. A downstream gasket 64*a* is connected to a tongue 68 extending towards the inside from a ring 56 of the casing 10 and also to a tongue 70 extending towards the outside from the turbine ring 30 that is furthest downstream in the turbine 7. In the example shown, the gaskets 64*a* and 64*b* are each pressed respectively against the nozzle 66 and the tongue of the turbine ring 30 of the first turbine stage, and against the tongue 68 and the tongue 70.

In a variant that is not shown, the nozzle 26 and the turbine ring 30 may form a single piece.

Beneficially, the turbine 7 also has a cooling device 80 for cooling the rotor disk with air taken from a cold portion of the turbine engine. By way of example, the cold portion may be a compressor. In the example shown, the cooling device comprises in particular a cold air feed channel 82 having one end 84 directed towards the downstream end of the turbine 7 and leading to the rotor disk 22 of the first stage 20 of the turbine 7. The channel 82 may be lagged. The channel 82 may cross the passage 39 via an inter-turbine casing (not shown). In order to enable the cold air delivered by the cooling system 80 to pass to the other stages of the turbine 7 that are situated further downstream, holes 90 may be provided in the rotor portions that would otherwise obstruct a good flow of air along the rotor disk 22 and in the proximity thereof. The channel 82 is provided with a valve 86 controlled by a control system 88. The valve 86 serves to regulate the flow of cold air that is delivered by the channel 84 to the rotor disk 22.

By regulating the flow rate of air delivered by the cooling device 80, it is possible to cool the rotor disk in controlled manner and thereby adjust the radial clearance J present between the tips of the blades 24 carried by the rotor disk 22 and the inside face of the turbine ring 30. In particular, cooling the rotor disk 22 (by increasing the flow rate of cold air) serves to increase the clearance J, whereas heating the rotor disk 22 (by reducing the flow rate of cold air) serves to reduce the clearance J. In order to regulate this air flow rate, the control system 88 may control the valve 86 as a function of parameters of the turbine engine that enable the magnitude of the clearance J to be estimated in real time.

The clearance J may be measured in real time using a capacitive sensor (not shown), e.g. present on a casing facing the radially outer ends of the blades 24 of the rotor disk 22, the sensor being connected to the control system 88. Such sensors are known and are generally used in the high pressure turbines of turbine engines.

The invention claimed is:

1. A turbine assembly for a turbine engine, the turbine assembly comprising:

a rotor disk having a plurality of blades made of ceramic matrix composite material;

a stationary nozzle made of ceramic matrix composite material arranged downstream from the rotor disk and comprising a plurality of nozzle vanes, each nozzle vane having an outer platform at an outer end, the outer platforms of the nozzle vanes together forming a nozzle ring around the nozzle vanes;

a turbine ring made as a single piece of ceramic matrix composite material having an inside face facing the outer ends of the blades of the rotor disk, the turbine ring being fastened to the nozzle ring in such a manner that the turbine ring and the nozzle ring together define an annular wall corresponding to the outer wall of a gas flow passage through the turbine; and a casing comprising an outer casing and a support structure including a plurality of cylindrical rings, the casing made of material presenting a coefficient of thermal expansion that is strictly greater than the coefficient of thermal expansion of the ceramic matrix composite material forming the blades of the rotor disk, the stationary nozzle, and the turbine ring, the casing extending around the nozzle ring and the turbine ring, at least one of the nozzle ring and the turbine ring being connected to the outer casing and one of the cylindrical rings of the casing via at least one sliding connection having a degree of freedom to move radially such that the casing is movable relative to said at least one of the nozzle ring and the turbine ring solely in a radial direction that is perpendicular to a longitudinal axis of the turbine assembly without stressing said at least one of the nozzle ring and the turbine ring to which the casing is connected, wherein the turbine ring connects at an upstream end of the turbine assembly to the outer casing and said one of the cylindrical rings via said at least one sliding connection.

2. The turbine assembly according to claim 1, wherein the annular wall is cylindrical in shape.

3. The turbine assembly according to claim 2, wherein the rotor disk is made of metal material, and the turbine assembly further comprises a cooling device for cooling the rotor disk with air taken from a cold portion of the turbine engine, said cooling device being controlled so as to adjust radial clearance between the ends of the blades carried by the rotor disk and the inside face of the turbine ring.

4. The turbine assembly according to claim 3, wherein the cooling device for cooling the rotor disk has a cold air delivery channel leading to the rotor disk and provided with a valve.

5. The turbine assembly according to claim 1, wherein the turbine ring and the stationary nozzle form two distinct parts, the turbine ring being fastened to the nozzle ring in leaktight manner.

6. The turbine assembly according to claim 1, wherein the turbine ring and the stationary nozzle form a single part.

7. The turbine assembly according to claim 1, wherein the stationary nozzle is connected to the casing via at least one sliding connection presenting a degree of freedom to move radially.

8. The turbine assembly according to claim 7, wherein the casing includes a circumferential groove in an inside face and the nozzle ring presents an annular tongue on an outside face, which tongue is received in the groove of the casing.

9. The turbine assembly according to claim 1, wherein the turbine ring is connected to the casing via at least one sliding connection presenting a degree of freedom to move radially.

10. The turbine assembly according to claim 9, wherein the casing has a groove in an inside face and the turbine ring has a tongue on an outside face, which tongue is received in the groove of the casing.

11. An aviation turbine engine including a turbine assembly according to claim 1.

12. A turbine assembly for a turbine engine, the turbine assembly comprising:

a rotor disk having a plurality of blades made of ceramic matrix composite material;

a stationary nozzle made of ceramic matrix composite material arranged downstream from the rotor disk and comprising a plurality of nozzle vanes, each nozzle vane having an outer platform at an outer end, the outer platforms of the nozzle vanes together forming a nozzle ring around the nozzle vanes;

a turbine ring made as a single piece of ceramic matrix composite material having an inside face facing the outer ends of the blades of the rotor disk, the turbine ring being fastened to the nozzle ring in such a manner that the turbine ring and the nozzle ring together define an annular wall corresponding to the outer wall of a gas flow passage through the turbine; and a casing comprising an outer casing and a support structure including a plurality of cylindrical rings, the casing made of material presenting a coefficient of thermal expansion that is strictly greater than the coefficient of thermal expansion of the ceramic matrix composite material forming the blades of the rotor disk, the stationary nozzle, and the turbine ring, the casing extending around the nozzle ring and the turbine ring, at least one of the nozzle ring and the turbine ring being connected to the outer casing and one of the cylindrical rings of the casing via at least one sliding connection having a degree of freedom to move radially such that the casing is movable relative to said at least one of the nozzle ring and the turbine ring solely in a radial direction that is perpendicular to a longitudinal axis of the turbine assembly without stressing said at least one of the nozzle ring and the turbine ring to which the casing is connected, wherein the nozzle ring connects to the outer casing and said one of the cylindrical rings via said at least one sliding connection.

* * * * *